US011511291B2

(12) United States Patent
Fritz et al.

(10) Patent No.: US 11,511,291 B2
(45) Date of Patent: Nov. 29, 2022

(54) APPLICATOR WITH A SMALL NOZZLE DISTANCE

(71) Applicant: Dürr Systems AG, Bietigheim-Bissingen (DE)

(72) Inventors: Hans-Georg Fritz, Ostfildern (DE); Benjamin Wöhr, Eibensbach (DE); Marcus Kleiner, Besigheim (DE); Mortiz Bubek, Ludwigsburg (DE); Timo Beyl, Besigheim (DE); Frank Herre, Oberriexingen (DE); Steffen Sotzny, Oberstenfeld (DE); Daniel Tandler, Stuttgart (DE); Tobias Berndt, Ditzingen (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 32 days.

(21) Appl. No.: 16/649,236

(22) PCT Filed: Sep. 27, 2018

(86) PCT No.: PCT/EP2018/076219
§ 371 (c)(1),
(2) Date: Mar. 20, 2020

(87) PCT Pub. No.: WO2019/063668
PCT Pub. Date: Apr. 4, 2019

(65) Prior Publication Data

US 2020/0246813 A1 Aug. 6, 2020

(30) Foreign Application Priority Data

Sep. 27, 2017 (DE) ..... 10 2017 122 495.5

(51) Int. Cl.
*B05B 1/30* (2006.01)
*B05B 1/14* (2006.01)
(Continued)

(52) U.S. Cl.
CPC ..... *B05B 1/3046* (2013.01); *B05B 1/14* (2013.01); *B41J 2/04* (2013.01); *B41J 2/17596* (2013.01)

(58) Field of Classification Search
CPC .. B05B 1/3046; B05B 1/14; B41J 2/04; B41J 2/17596
(Continued)

(56) References Cited

U.S. PATENT DOCUMENTS 2,296,079 A 9/1942 Helmer
4,157,149 A 6/1979 Moen
(Continued)

FOREIGN PATENT DOCUMENTS

CN 1420070 A 5/2003
CN 101480642 A 7/2009
(Continued)

OTHER PUBLICATIONS

Chinese Office Action for Application No. 201880062988.0 dated Feb. 26, 2021 (13 pages; with English translation of Search Report).
(Continued)

*Primary Examiner* — Steven J Ganey
(74) *Attorney, Agent, or Firm* — Bejin Bieneman PLC

(57) ABSTRACT

The disclosure relates to an applicator, in particular a printhead, for applying a coating agent, in particular a paint, to a component, in particular a motor vehicle body component or an add-on part for a motor vehicle body component, having at least one nozzle row with a plurality of nozzles for dispensing the coating agent in the form of a coating agent jet, the nozzles are arranged one behind the other in a nozzle plane along the nozzle row at a specific nozzle spacing, and having a plurality of actuators for controlling the release of coating agent through the individual nozzles, the actuators each having an outer dimension along the nozzle row. The
(Continued)

disclosure provides that the nozzle distance between the adjacent nozzles of the nozzle row is smaller than the outer dimension of the individual actuators along the nozzle row.

28 Claims, 9 Drawing Sheets

(51) Int. Cl.
*B41J 2/04* (2006.01)
*B41J 2/175* (2006.01)

(58) Field of Classification Search
USPC ..... 239/548, 566, 583
See application file for complete search history.

(56) References Cited

U.S. PATENT DOCUMENTS

| | | | |
|---|---|---|---|
| 4,809,017 | A | 2/1989 | Fost |
| 4,998,502 | A | 3/1991 | Schucker |
| 5,022,629 | A | 6/1991 | Tibbals, Jr. |
| 5,066,216 | A | 11/1991 | Kowtko |
| 5,769,947 | A | 6/1998 | Krappweis |
| 5,800,614 | A | 9/1998 | Foust |
| 6,371,603 | B1 | 4/2002 | Seto |
| 6,776,360 | B2 | 8/2004 | Haruch |
| 7,332,035 | B1 * | 2/2008 | Tudor ..... B05B 13/0431 118/315 |
| 7,357,485 | B2 | 4/2008 | Silverbrook |
| 8,286,898 | B2 | 10/2012 | Muljono |
| 9,044,764 | B2 | 6/2015 | Jochheim |
| 9,108,424 | B2 | 8/2015 | Wallsten et al. |
| 9,403,367 | B2 | 8/2016 | Reder |
| 9,586,342 | B2 | 3/2017 | Shaddock |
| 10,016,977 | B2 | 7/2018 | Stefani |
| 11,254,126 | B2 | 2/2022 | Wang |
| 2005/0046673 | A1 | 3/2005 | Silverbrook et al. |
| 2008/0011227 | A1 | 1/2008 | Arnaboldi |
| 2009/0079792 | A1 | 3/2009 | Koizumi |
| 2012/0055178 | A1 | 3/2012 | Takahashi et al. |
| 2013/0127955 | A1 | 5/2013 | Ataka et al. |
| 2015/0360472 | A1 | 12/2015 | Obertegger et al. |

FOREIGN PATENT DOCUMENTS

| | | | |
|---|---|---|---|
| CN | 101553685 | A | 10/2009 |
| CN | 101616755 | A | 12/2009 |
| CN | 201415168 | Y | 3/2010 |
| CN | 104647903 | A | 5/2015 |
| CN | 106414081 | A | 2/2017 |
| CN | 106573258 | A | 4/2017 |
| DE | 2612614 | A1 | 10/1976 |
| DE | 3302617 | A1 | 8/1984 |
| DE | 3506393 | A1 | 8/1986 |
| DE | 3634137 | A1 | 4/1988 |
| DE | 69126667 | T2 | 1/1998 |
| DE | 102014013158 | A1 | 3/2016 |
| EP | 0276053 | A1 | 7/1988 |
| EP | 0426473 | A2 | 5/1991 |
| EP | 1862311 | A1 | 12/2007 |
| EP | 2055394 | A2 | 5/2009 |
| EP | 2646170 | B1 | 1/2015 |
| JP | S63-165147 | A | 7/1988 |
| JP | H05-293959 | A | 11/1993 |
| JP | 2001-146010 | A | 5/2001 |
| JP | 2008119554 | A | 5/2008 |
| JP | 2009-078398 | A | 4/2009 |
| JP | 2009106934 | A | 5/2009 |
| JP | 2011-514234 | A | 5/2011 |
| JP | 2013-107256 | A | 6/2013 |
| JP | 2015096322 | A | 5/2015 |
| WO | 92/07121 | A2 | 4/1992 |
| WO | 2007056098 | A2 | 5/2007 |
| WO | 2012058373 | A2 | 5/2007 |
| WO | 2010046064 | A1 | 4/2010 |
| WO | 2010134153 | A1 | 11/2010 |
| WO | 2012072576 | A1 | 6/2012 |
| WO | 2013140814 | A1 | 9/2013 |

OTHER PUBLICATIONS

Chinese Office Action for Application No. CN201880063177.2 dated Mar. 29, 2021 (21 pages; with English machine translation).
International Search Report and Written Opinion for PCT/EP2018/076219 dated Jul. 12, 2018 (17 pages; with English translation).
International Search Report and Written Opinion for PCT/EP2018/075504 dated Dec. 7, 2018 (17 pages; with English translation).
EPO Third Party Observations for Patent No. EP3687701 dated Oct. 1, 2020 (7 pages).
Non-Final Office Action dated Jun. 15, 2022 in related U.S. Appl. No. 16/649,217 (74 pages).
Notification of Reasons for Rejection from the Japan Patent Office for Application No. JP2020518024 dated Jul. 5, 2022 (9 pages; with English translation).
Motification of Reasons for Rejection from the Japan Patent Office for related application No. JP2020-518041 dated Sep. 6, 2022 (12 pages; with English translation).

* cited by examiner

APPLICATOR WITH A SMALL NOZZLE DISTANCE

CROSS-REFERENCE TO RELATED APPLICATIONS

This application is a national stage of, and claims priority to, Patent Cooperation Treaty Application No. PCT/EP2018/076219, filed on Sep. 27, 2018, which application claims priority to German Application No. DE 10 2017 122 495.5, filed on Sep. 27, 2017, which applications are hereby incorporated herein by reference in their entireties.

FIELD

The disclosure concerns an applicator (e.g. printhead) for applying a coating agent (e.g. paint) to a component (e.g. motor vehicle body component or add-on part for a motor vehicle body component).

BACKGROUND

So-called drop-on-demand printheads are known from the state of the art (e.g. U.S. Pat. No. 9,108,424 B2), which emit a droplet jet or a continuous coating agent jet and whose operating principle is based on the use of electromagnetic valves. A magnetically driven armature is slidably guided in a coil. The sliding armature can directly form a valve needle or indirectly act on a separate valve needle which, depending on its position, optionally closes a valve seat or releases it for a release of coating agent. The nozzles for dispensing the coating agent and the associated electromagnetic actuators are arranged one behind the other along a nozzle row. Such printheads are also described in WO 2012/058373 A2. These well-known printheads also work with valve pistons which are moved by electromagnetic actuators, whereby the valve pistons run in an inner guide tube (coil inner tube) in the coil.

The problem with the well-known drop-on-demand printheads is the distance between the adjacent nozzles, as explained below with reference to FIGS. 1 to 4. For example, known drop-on-demand printheads typically have a nozzle plate 1 with numerous nozzles 2-4 arranged in the nozzle plate 1 along a linear nozzle row 5. The individual nozzles 2-4 can each emit a coating agent jet onto the surface of a component 6, as indicated by arrows in FIGS. 1 and 2. The control of the coating agent delivery through the nozzles 2-4 is carried out individually by actuators 7-9, which operate electromagnetically and each move a valve needle 10-12 in the direction of the double arrow in FIG. 3. The valve needle 11 is shown in FIG. 3 in a lowered position, in which the valve needle 11 closes the corresponding nozzle 3 for a coating agent discharge. The valve needles 10 and 12, however, are shown in FIG. 3 in a raised position, in which the two valve needles 10, 12 release the corresponding nozzles 2, 4 for a coating agent discharge.

In addition, FIG. 3 shows a sealing membrane 13 which fluidically separates a coating-filled nozzle chamber 14 from an actuator chamber 15 in the printhead. The sealing membrane 13 thereby prevents the coating agent from the nozzle chamber 14 from contaminating the actuators 7-9 in the actuator chamber 15. The sealing membrane 13 is suspended in a membrane decoupling 16, whereby the membrane decoupling 16 prevents a displacement of one of the valve needles 10-12 from causing a corresponding displacement of the adjacent valve needles 10-12. The membrane decoupling 16 thus causes a mechanical decoupling between the adjacent valve needles 10-12 so that they can control the release of coating agent through the nozzles 2-4 individually and independently of each other.

FIG. 4 also shows that the adjacent actuators 7-9 are arranged at a certain distance d along the nozzle row 5. The individual actuators 7-9 each have a diameter b, which limits the minimum achievable nozzle distance d downwards. The nozzles 2-4 cannot be arranged close to each other along the nozzle row 5. This can lead to the fact that from the nozzles 2-4 coating agent droplets 17-19 are released onto the surface of the component 6, which—as shown in FIG. 1—are too far apart to run to a coherent coating agent film after application.

To mitigate this problem of nozzle spacing d being too large, it is known from the state of the art to rotate the printhead during operation about an axis of rotation 20 which is perpendicular to the surface of the component 6 and perpendicular to the painting path which is perpendicular to the drawing plane. As a result, the effective nozzle distance d is reduced in the drawing plane, i.e. at right angles to the painting path. This rotation of the drop-on-demand printhead allows the coating droplets 17-19 on the surface of the component 6 to be so close together that, after application, they form a continuous coating film as shown in FIG. 2. The rotation of the drop-on-demand nozzle head thus mitigates the problem that the minimum nozzle distance d is limited by the diameter b of the actuators 7-9. However, it would be desirable to be able to do without such a rotation. In particular, it would be desirable to reduce the nozzle distance d in a printhead.

With regard to the technical background of the disclosure, reference should also be made to EP 0 426 473 A2, US 2013/0127955 A1, WO 2012/058373 A2, DE 10 2014 013158 A1 and WO 2010/046064 A1.

DETAILED DESCRIPTION

Figure 1:
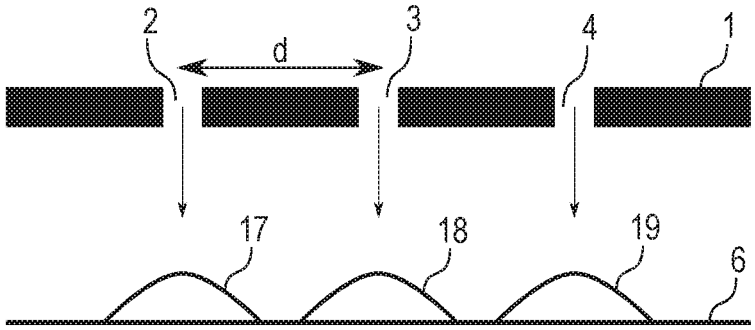
Fig. 1 Prior art
FIG. 1 shows a schematic representation of a printhead according to the disclosure, where the coating drops do not converge to a continuous coating film, FIG. 2 a variation of FIG. 1 with a rotated printhead so that the coating droplets converge into a continuous coating film.
Figure 2:
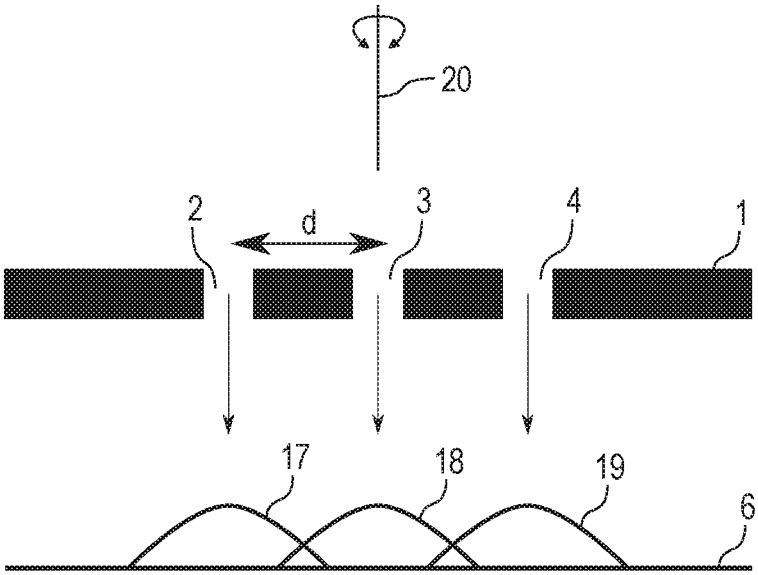
Fig. 2 Prior art
Figure 3:
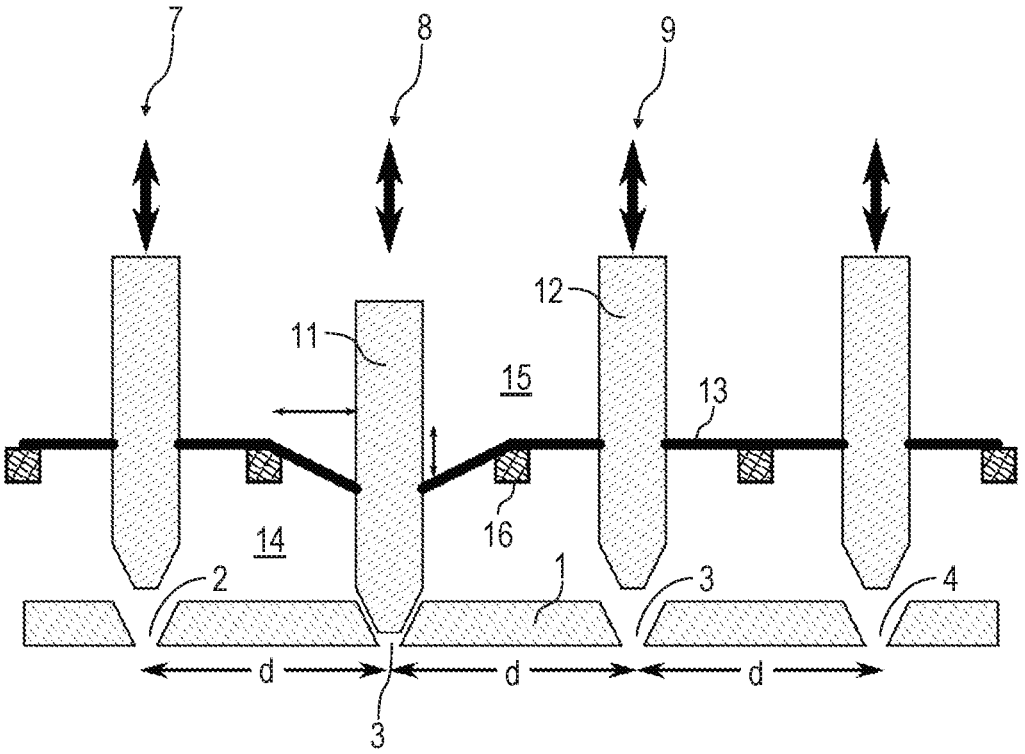
Fig. 3 Prior art
FIG. 3 shows a schematic representation of a conventional printhead, FIG. 4 a schematic cross-sectional view through a printhead according to the disclosure to illustrate the nozzle spacing.
Figure 4:
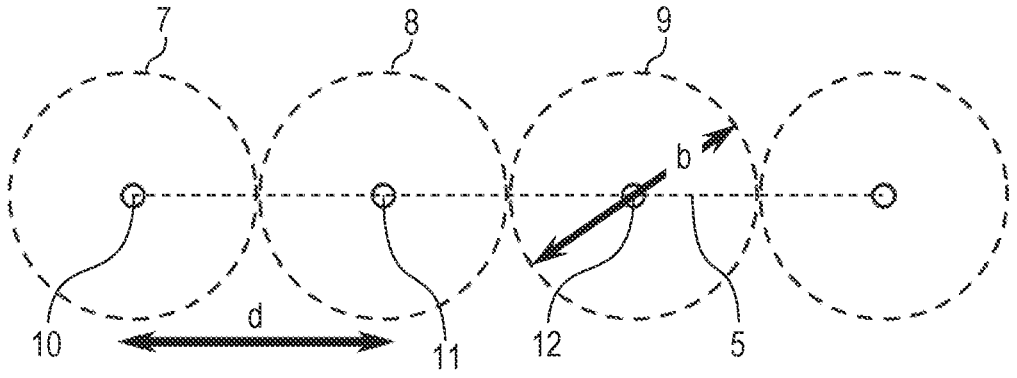
Fig. 4 Prior art

The applicator (e.g. printhead) according to the disclosure is generally suitable for the application of a coating agent. The disclosure is therefore not limited to a specific coating agent with regard to the type of coating agent to be applied. Preferably, however, the printhead is designed for the application of a paint. However, the coating agent can alternatively be an adhesive or a sealing or insulating material. The applicator according to the disclosure can therefore also be designed as an adhesive applicator or as a sealing applicator.

It should also be mentioned that the printhead according to the disclosure is generally suitable for applying the coating agent (e.g. paint) to a specific component. With regard to the type of component to be coated, the disclosure is also not limited. Preferably, however, the applicator according to the disclosure is designed to apply a coating agent (e.g. paint) to a motor vehicle body component or an add-on part of a motor vehicle body component.

The applicator in accordance with the disclosure (e.g. printhead) initially has, in accordance with the state of the art, a nozzle row with several nozzles in order to apply the coating agent each time in the form of a coating agent jet, the nozzles being arranged along the nozzle row preferably in a common nozzle plane.

It should be mentioned here that the printhead according to the disclosure does not emit a spray cone of the coating agent from the nozzles, but rather spatially limited coating agent jets (essentially continuous jet or drop jet) with only a small jet expansion. The applicator according to the disclosure is therefore different from atomizers (e.g. rotary atomizers, air atomizers, etc.), which do not emit a spatially limited jet of coating agent, but a spray cone of the coating agent.

It should also be mentioned that the applicator (e.g. printhead) according to the disclosure can have a single nozzle row in which the nozzles are preferably arranged equidistantly. However, within the scope of the disclosure there is also the possibility that the printhead has several nozzle rows, which are preferably arranged parallel to each other.

In addition, in accordance with the state of the art, the printhead according to the disclosure has several actuators in order to either release or close the nozzles, as already described at the beginning with regard to the state of the art.

The actuators can, for example, be electromagnetic actuators, as already described at the beginning. Alternatively, it is also possible that the actuators are piezoelectric actuators or pneumatic actuators, to name just a few examples. The disclosure is therefore not limited to a specific actuator type with regard to the technical-physical principle of action of the actuators.

The disclosure provides for a nozzle distance between the adjacent nozzles of the nozzle row is smaller than the outer dimension (e.g. outer diameter) of the individual actuators along the nozzle row. The disclosure thus overcomes the lower limit for the nozzle distance described above, which was previously given by the external dimensions of the individual actuators. So far, the nozzle distance between the adjacent nozzles of the nozzle rows could not be smaller than the outer dimension of the individual actuators, since the available installation space for the actuators would otherwise not be sufficient. It should be mentioned here that the nozzle distance is measured between the centres of the nozzles.

This reduction of the nozzle distance with unchanged external dimensions of the individual actuators can be achieved within the scope of the disclosure by a fluidic pulling-apart of the applicator, in which the control valves and/or the actuators are no longer arranged exactly in the nozzle row, but offset to it. Thus, the applicator according to the disclosure can have several control valves to control the release of coating agent through the nozzles, whereby the control valves are controlled by the actuators. The fluidic equalisation then preferably provides for the control valves to be spatially separated from the associated nozzle and each connected to the associated nozzle via a flow channel in order to enable spatial equalisation of the nozzles on the one hand and the valves on the other. The individual control valves are arranged with their shut-off point offset to the side of the nozzle row in order to be able to reduce the nozzle distance. This offset arrangement of the control valves also allows a laterally offset arrangement of the actuators, so that the nozzle distance is no longer limited by the external dimensions of the individual actuators.

In one example of the disclosure, the control valves on both sides of the nozzle row are arranged one behind the other in two valve rows opposite to the nozzle row. The nozzles along the nozzle row can then be connected alternately via the flow channels with control valves of the opposite valve rows. For example, the first nozzle of the nozzle row can be connected to a control valve of the left valve row, while the second nozzle of the nozzle row is connected to a control valve of the right valve row. The third nozzle of the nozzle row is then connected again with a valve from the left valve row and so on. This allows the nozzle distance of the adjacent nozzles along the nozzle row to be reduced to half the outer dimension of the individual actuators.

In a different configuration of the disclosure, the flow channels depart from the nozzle row in a pulling-apart plane at right angles to the nozzle row in more than two different directions, namely at different angles, starting from the nozzle row, whereby the different directions of the flow channels in the pulling-apart plane can each include an angle of 0°-90°, 20°-70°, 30°-60°, 40°-50° or in particular 0° or 45°. The nozzles along the nozzle row are then alternately connected to one of the various flow channels. The actuators are thus arranged in different angular positions in the pulling-apart plane and are thus also spatially pulled-apart, which enables a greater packing density and a correspondingly smaller nozzle distance.

In a further example of the disclosure, the actuators are arranged in several actuator planes, whereby the actuator planes run parallel to the nozzle plane and/or to the valve seat plane at different distances from the nozzle plane or valve seat plane. The actuators in the individual actuator planes can be arranged in several actuator rows parallel to the nozzle row and/or to the valve seat row, especially on both sides of the nozzle row and/or the valve seat row. The actuators can therefore be arranged vertically pulled-apart, i.e. at right angles to the nozzle plane at different distances. In addition, the actuators can also be arranged horizontally pulled-apart, i.e. distributed parallel to the nozzle plane. This spatial pulling-apart of the actuators in different directions (horizontal and vertical) also allows a reduction of the nozzle distance.

In one example of the disclosure, the actuators are arranged in several actuator planes, with the individual actuator planes running parallel to the nozzle plane and/or to the valve seat row. Two actuator rows are arranged on both sides of the nozzle row in the individual actuator planes, whereby the actuator rows each contain several actuators.

Here the actuator planes arranged vertically (i.e. at right angles to the nozzle plane and/or to the valve seat plane) above one another preferably have a horizontal offset to one another which is substantially the same size as the nozzle spacing or an integral multiple of the nozzle spacing between the adjacent nozzles in the nozzle row. However, the offset can also be an integer multiple of the nozzle spacing. In addition, the actuators in the individual actuator rows are preferably arranged essentially equidistantly.

It should also be mentioned that the control valves can be arranged at different distances from the associated nozzles. As a result, the associated flow channels between the control valves and the associated nozzles have different lengths. The different lengths of the flow channels can in turn lead to different flow behaviour, so that the coating agent discharge through the individual nozzles is different. However, it is desirable that the coating agent delivery through the individual nozzles is uniform regardless of the length of the flow channels. It is therefore possible within the scope of the disclosure to compensate the different length of the flow channels with pressure compensating means, so that the different nozzles have a uniform discharge behaviour independent of the length of the associated flow channels.

For example, the pressure compensating means can consist of a meander-shaped course, a zigzag-shaped channel course, a spiral-shaped channel course or a channel narrowing of the flow channel, whereby these pressure compensating means are preferably arranged in the shorter flow channels, as these would otherwise have a lower flow resistance due to their shorter length.

It should also be mentioned that the individual control valves can each have a valve seat which can be either closed or released. The individual valve seats can have a clear diameter of 50 μm-1500 μm when open.

In addition, the individual control valves have a deflectable valve element, which can be a flexible valve membrane, for example. The deflectable valve element (e.g. valve membrane) can then either release or close the valve seat depending on its deflection.

The disclosure provides various options for deflecting the valve element (e.g. valve membrane), which are briefly described below.

In one example of the disclosure, a sliding plunger is provided which is moved by the associated actuator and in a closed position presses the valve element (e.g. valve membrane) against the valve seat, thereby sealing the valve seat.

In another example of the disclosure, however, a pressure chamber is provided which can be subjected to a variable pressure, whereby the pressure in the pressure chamber acts on the deflectable valve element (e.g. valve membrane). By applying sufficient pressure to the pressure chamber, the valve element (e.g. valve membrane) can be pressed against the valve seat and thus seal it. For example, the pressure chamber can be pressurized with compressed air.

It should be mentioned here that the valve element (e.g. valve membrane) can extend over several of the valve seats, whereby the common valve element can still be deflected individually for the individual valve seats so that the release of coating agent through the individual nozzles can be controlled individually.

Here it is also possible that the valve element (e.g. valve membrane) fulfils the same function as the sealing membrane mentioned at the beginning with regard to the state of the art, which separates an actuator chamber from a coating agent-filled supply line chamber and thus prevents the actuators in the actuator chamber from being contaminated by the coating agent. The valve element (e.g. valve membrane) thus has two functions, namely the opening and closing of the nozzles on the one hand and the fluidic separation of the actuator chamber from the supply line chamber on the other hand.

It should also be mentioned that the individual control valves can each have a return spring, whereby the return spring can preload the plunger into a closed position or into an open position. Preferably, however, the return spring preloads the plunger into the closed position, i.e. the associated control valve is closed without active actuation.

In addition, a sliding valve needle can be provided instead of a valve membrane, whereby the valve needle either releases or closes the valve seat depending on its position. The valve needle can be passed through a sealing element (e.g. sealing membrane), whereby the sealing element separates the actuator chamber from the coating agent-filled supply line chamber and thus prevents the actuators in the actuator chamber from being contaminated by the coating agent. This valve needle may have a separate sealing element at its tip.

It should also be mentioned that the valve needle or plunger can each be moved by an actuator, which can be an electromagnetic actuator, a piezoelectric actuator or a pneumatic actuator, for example. The disclosure is therefore not limited to a specific principle of action with regard to the technical-physical principle of action of the actuator.

It should also be mentioned that the individual actuators can be single or double acting. With a single-acting actuator, the valve needle or tappet is only actively moved in one direction by the associated actuator, whereas the return movement is affected by a return spring. With a double-acting actuator, on the other hand, both movements in the opposite directions are actively affected by the associated actuator, so that a return spring could also be dispensed with.

It is also possible for the individual control valves to be arranged outside the applicator, whereby the control valves are then connected to the applicator by a fluid line (e.g. hose).

The applicator according to the disclosure can also have a common supply channel to supply the individual flow channels for the individual valves with the coating agent. For example, this supply channel can have a channel height of 100 μm-2000 μm, a channel width of 1 mm-5 mm and/or a channel length of 1 mm-100 mm.

The reduction of the nozzle distance according to the disclosure enables the distance between the adjacent valve seats to be at least twice as large as the nozzle distance between the adjacent nozzles.

The flow channel and/or the supply channel in the applicator can be produced by different manufacturing processes. The following manufacturing processes are to be mentioned as examples:

Lithography processes, in particular soft lithography processes, 3D printing,
Sacrificial layer method,
Escargot procedure,
LIGA process,
thermal bonding,
Diffusion welding,
Laser ablation,
Laser cutting,
Bonding, hot stamping,
Etching process,
Injection moulding,
selective laser sintering,
selective laser melting,
mechanical processing,
a combination of the above methods.

The flow channel and/or the supply channel can run in a substrate (i.e. a housing body) made of a material that is inert to the coating agent. For example, the substrate may be stainless steel, plastic, silicon or glass. The following plastics, for example, can be used as plastics:

Polyetheretherketone (PEEK),
Polyetherketone (PEKK),
Polyoxymethylene (POM),
Polymethyl methacrylate (PMMA),
Polyamide (PA),
Polyethylene (PE),
Polypropylene (PP),
Polystyrene (PS),
Polycarbonate (PC),
Cycloolefin copolymers, in particular Topas®, Zeonor® or Zeonex®.

With regard to the flow channels, it should also be mentioned that these can enclose an angle of 0-90°, 20°-85°, 45°-80° with the coating agent jet over at least part of their length.

Furthermore, the flow channels may be at an angle of 0-90° or 45°-90° or transverse, in particular perpendicular, to the nozzle row over at least part of their length.

The individual flow channels can each have a channel cross-section with a channel height of 50 μm-1000 μm or 100 μm-500 μm.

The channel width of the individual flow channels, on the other hand, is preferably in the range of 50 μm-1000 μm or 100 μm-500 μm.

The channel length of the individual flow channels is preferably in the range of 0.1 mm-50 mm or 0.5 mm-25 mm. A short duct length is desirable so that the flow channels between the shut-off point of the control valves on the one hand and the nozzles on the other hand have as small a volume as possible, so that dripping is prevented and good dynamic response behaviour is achieved. The volume of the flow channels between the shut-off point of the control valves and the nozzles is therefore preferably smaller than 1 mL, 0.5 mL, 0.1 mL, 0.01 mL or 0.001 mL.

It should also be mentioned that the flow channels can also have a round channel cross-section, in particular with a channel diameter of 50 μm-1000 μm.

The disclosure allows a very small nozzle distance of the adjacent nozzles along the nozzle row, whereby the nozzle distance can be smaller than 3 mm, 2 mm, 1 mm or even smaller than 0.5 mm.

The control valves, on the other hand, with their shut-off points are preferably arranged at a distance of at least 1 mm, 2 mm, 3 mm, 4 mm, 5 mm or 6 mm from the nozzle row in order to enable spatial pulling-apart of the control valves on the one hand and the nozzles on the other hand.

It should also be mentioned that the nozzles are preferably arranged equidistantly along the nozzle row.

In addition, it should be mentioned that the disclosure does not only claim protection for the above described applicator. Rather, the disclosure also claims protection for a coating robot (e.g. painting robot) with such an applicator.

Figure 5:
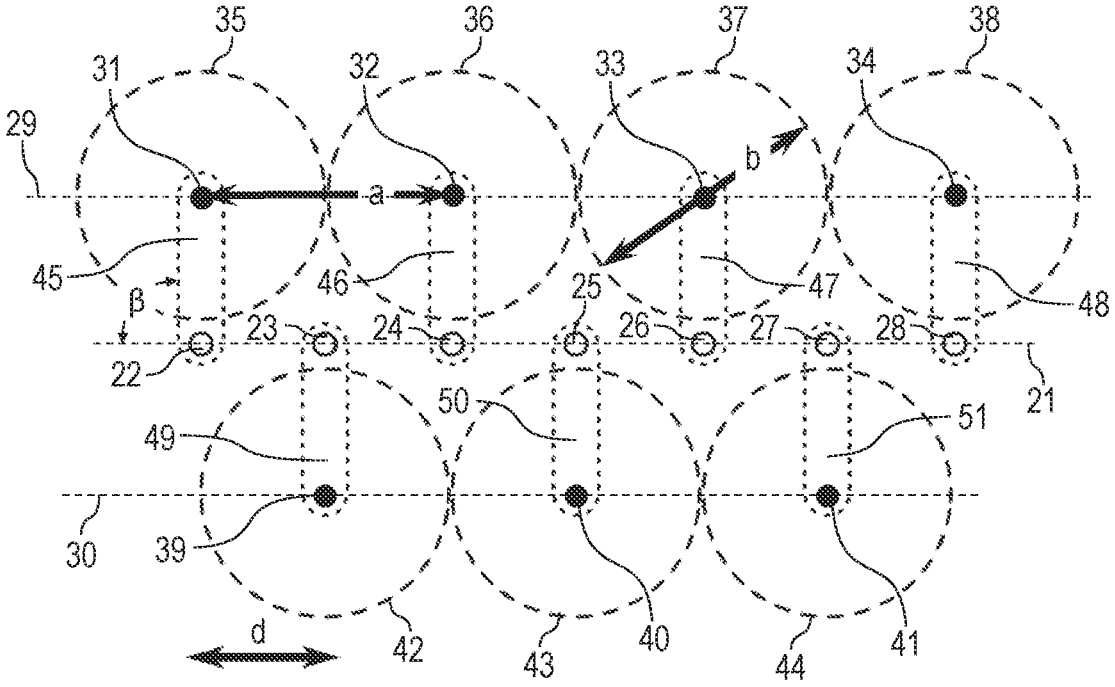
FIG. 5 shows a schematic representation of a printhead according to the disclosure.

In the following, with reference to FIGS. 5 and 8, an example of a printhead according to the disclosure is described, which can be used, for example, to paint motor vehicle body components.

Numerous nozzles 22-28 are arranged equidistantly in a linear nozzle row 21.

On both sides of nozzle row 21 there are parallel valve seat rows 29, 30.

In the valve seat row 29, numerous valve seats 31-34 are arranged equidistantly at a distance a. The valve seats 31-34 are each opened or closed by actuators, whereby the actuators 35-38 each close an unrepresented valve needle in order to individually close or open the valve seats 31-34.

In the opposite valve seat row 30, there are also several valve seats 39-41 arranged equidistantly at the distance a. These valve seats 39-41 are also closed or opened via actuators 42-44, whereby the actuators 42-44 each move an unrepresented valve needle to open or close the valve seats 39-41.

The valve seats 31-34 of the upper valve seat row 29 in the drawing are each connected to the corresponding nozzles 22, 24, 26, 28 by flow channels 45-48.

The valve seats 39-41 of the valve seat row 30 below in the drawing are connected accordingly via flow channels 49-51 with the corresponding nozzles 23, 25, 27.

In this arrangement, the actuators 35-38 are offset upwards relative to the nozzle row 21 in the drawing, while the actuators 42-44 are offset downwards relative to the nozzle row 21 in the drawing. This spatial pulling-apart of the actuators 35-38 or 42-44 on one side and the nozzle row 21 on the other enables a reduction of the nozzle distance d below the distance a between the adjacent actuators 35-38 or 42-44. In particular, the nozzle distance d of the adjacent nozzles 22-28 can also be smaller than the diameter b of the individual actuators 35-38 or 42-44.

Figure 8:
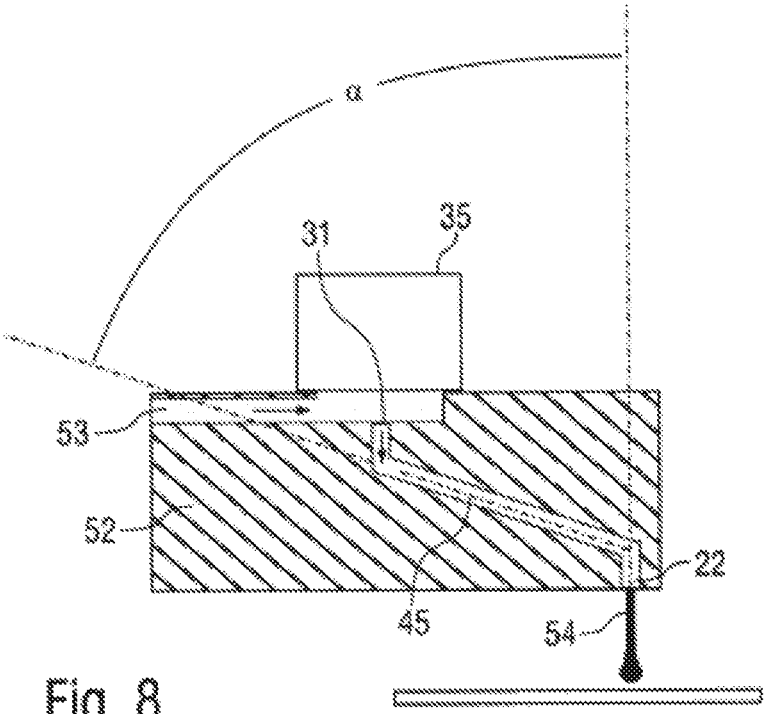
FIG. 8 shows a schematic illustration of the lateral pulling-apart of the control valves, FIG. 9A a schematic representation of an embodiment of a printhead according to the disclosure with a control valve with a tappet-actuated valve membrane in the open state, FIG. 9B the printhead according to FIG. 9A in a closed position, FIG. 10A a variation of FIG. 9A having a pressure chamber for deflecting the valve membrane, wherein the valve membrane is shown in the open state, FIG. 10B a variation of FIG. 10A in the closed state of the valve membrane.

The cross-sectional view in FIG. 8 also shows that the flow channel 45, like the other flow channels, runs in a substrate 52, with a supply channel 53 embedded in the upper side of the substrate 52, which supplies the valve seats 31-34 with the coating agent.

FIG. 8 further shows that the flow channel 45 extends over part of its length at an angle α relative to a coating agent jet 54 discharged from the nozzle 22. The angle α can be in the range of 0°-90°, especially 0° or 45°.

Figure 6:
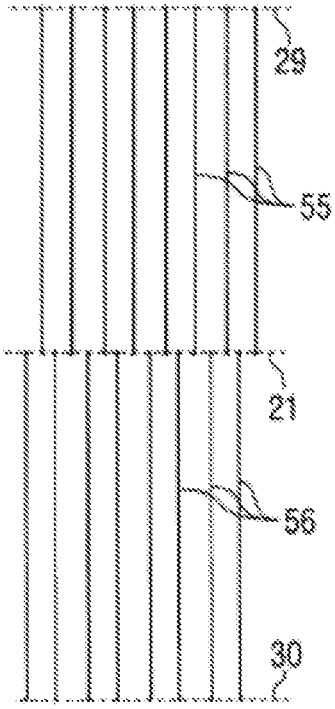
FIG. 6 shows a schematic illustration of the spatial pulling-apart of the control valves in lateral direction.

FIG. 6 shows a schematic diagram of such a printhead arrangement with laterally offset valve seats arranged opposite the nozzle row 21 in the two valve seat rows 29, 30.

In part, this representation was consistent with the previous drawings, so that reference is made to the above description to avoid repetition, using the same reference symbols for corresponding details.

Flow channels 55, 56 are provided, all of the same length. This offers the advantage that the flow resistance of the flow channels 55, 56 is uniform, so that the application behaviour of the individual nozzles is also uniform.

Figure 7:
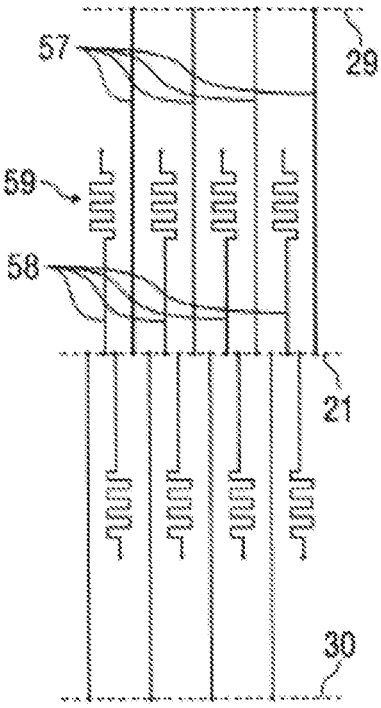
FIG. 7 shows a schematic illustration of pressure compensating means in the individual flow channels.

FIG. 7 shows a modification of the schematic representation according to FIG. 6, so that the above description is referred to first in order to avoid repetitions, using the same reference symbols for the corresponding details.

A feature of this example is that the printhead has long flow channels 57 and short flow channels 58. This is problematic because the flow resistance of the short flow channels 58 is generally lower than the flow resistance of the long flow channels 57, which would lead to correspondingly different application behaviour. In the short flow channels 58, therefore, pressure compensating means 59 are arranged, which in this embodiment consist of a meander-shaped course of the short flow channels 58.

Figure 9A:
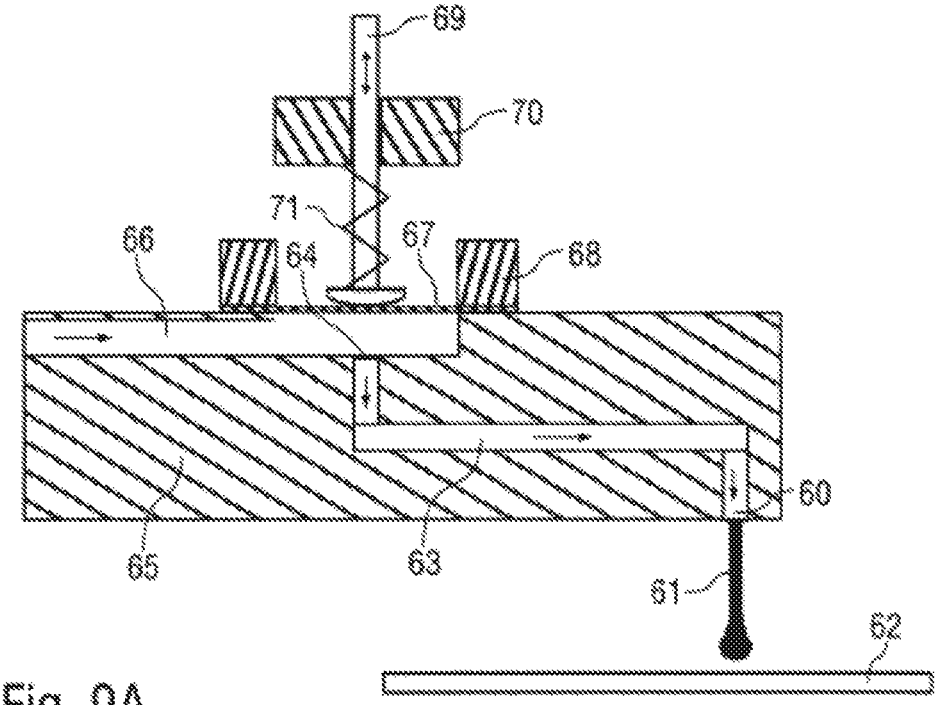
Figure 9B:
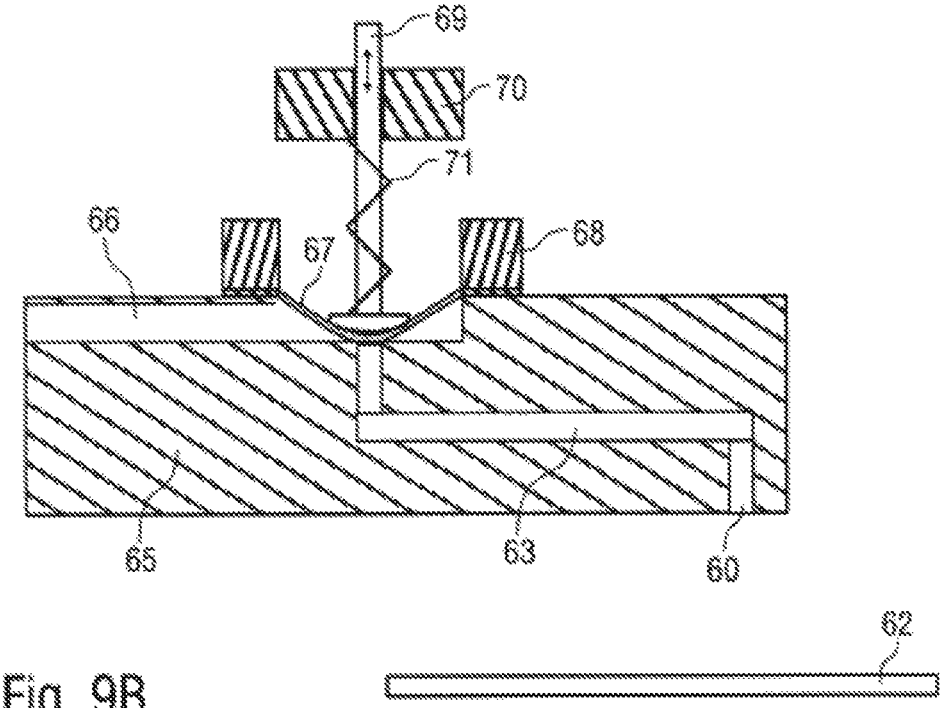

In the following, the embodiment according to FIGS. 9A and 9B is described, where FIG. 9A shows an open position of a control valve, while FIG. 9B shows a closed position of the control valve.

The drawings show a schematic detail of the printhead in the area of a nozzle 60, whereby a coating agent jet 61 can be delivered to a component 62 through the nozzle 60.

The nozzle 60 is connected via a flow channel 63 with a valve seat 64 laterally offset to the nozzle 60, whereby the flow channel 63 runs in a substrate 65. A supply channel 66 is embedded in the surface of the substrate 65 and leads to the valve seat 64.

In addition, a valve membrane 67 is fixed to the top of the substrate 65 by a membrane clamp 68, whereby the valve membrane 67 is deflectable between the open position according to FIG. 9A and the closed position according to FIG. 9B.

The valve membrane 67 is deflected by a valve stem 69 which is guided in a plunger guide 70 and can be moved by an actuator in the direction of the double arrow.

The valve stem 69 is pushed downwards into the closed position by a return spring 71. In the closed position as shown in FIG. 9B, the valve stem 69 presses the valve membrane 67 onto the valve seat 64 and seals it.

The lateral offset between the nozzle 60 and the valve seat 64 allows the nozzle distance between the adjacent nozzles (i.e. perpendicular to the drawing plane) to be reduced.

Figure 10A:
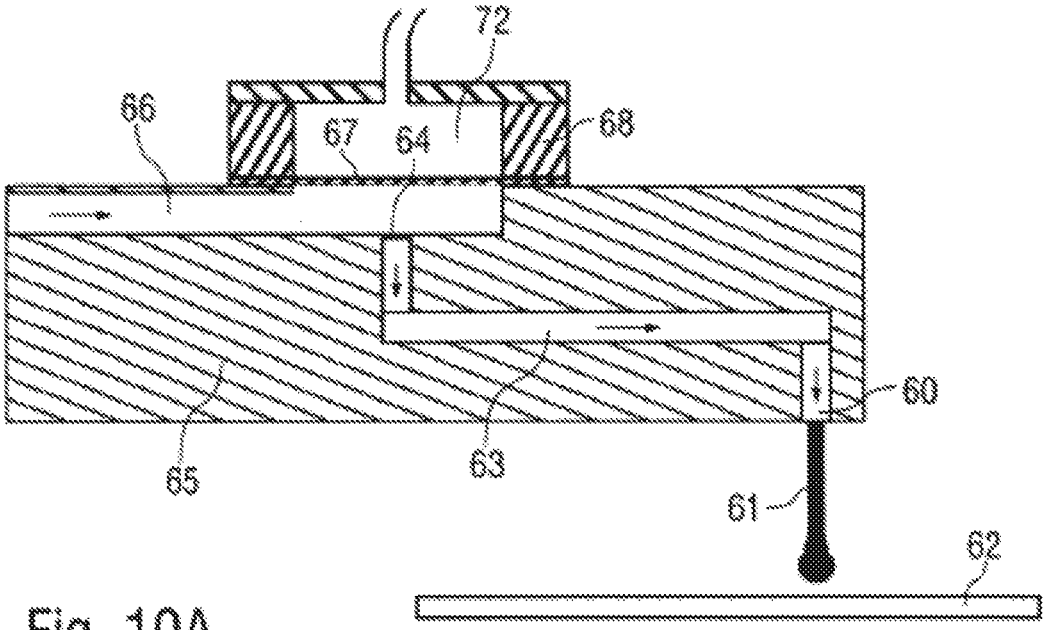
Figure 10B:
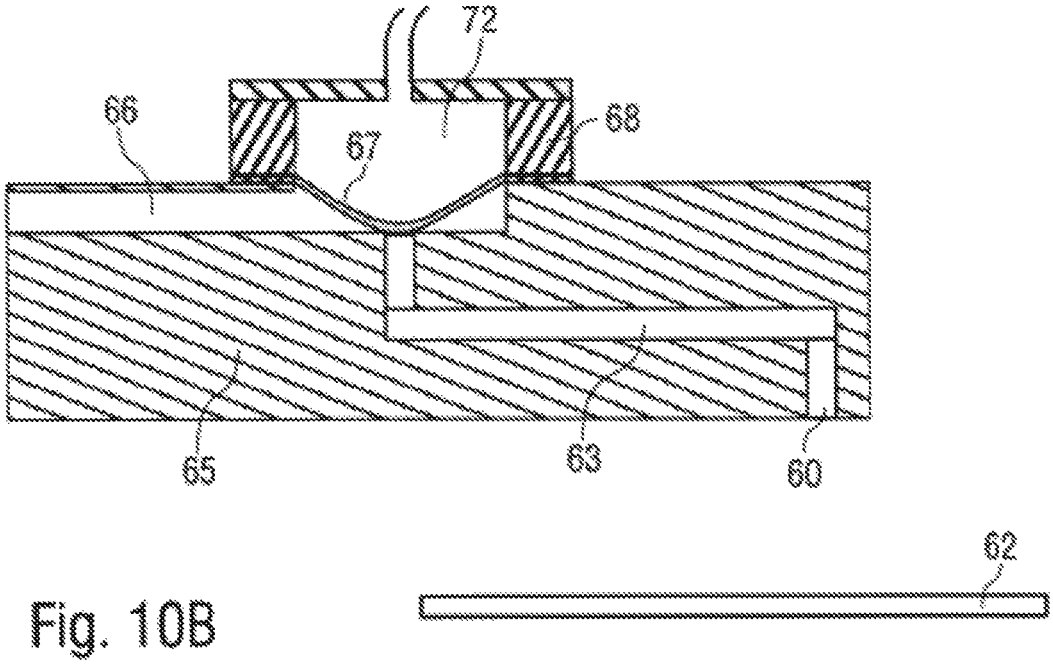

FIGS. 10A and 10B show a variation of the embodiment given in FIGS. 9A and 9B so that reference is made to the above description to avoid repetition, using the same reference signs for appropriate details.

A feature of this embodiment is that the valve membrane 67 is not deflected by the plunger 69, but by the pressure in a pressure chamber 72, which can be pressurized with compressed air.

Figure 11A:
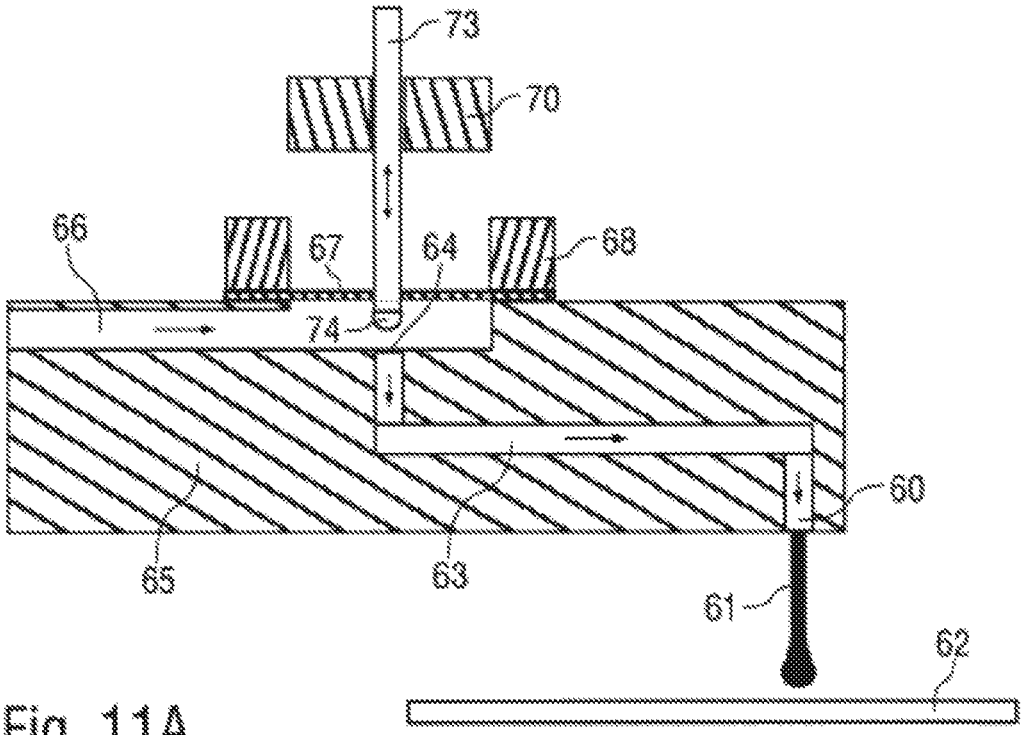
FIG. 11A is a variation of FIG. 9A with a separate valve tappet that slides through a sealing membrane and is shown when open.
Figure 11B:
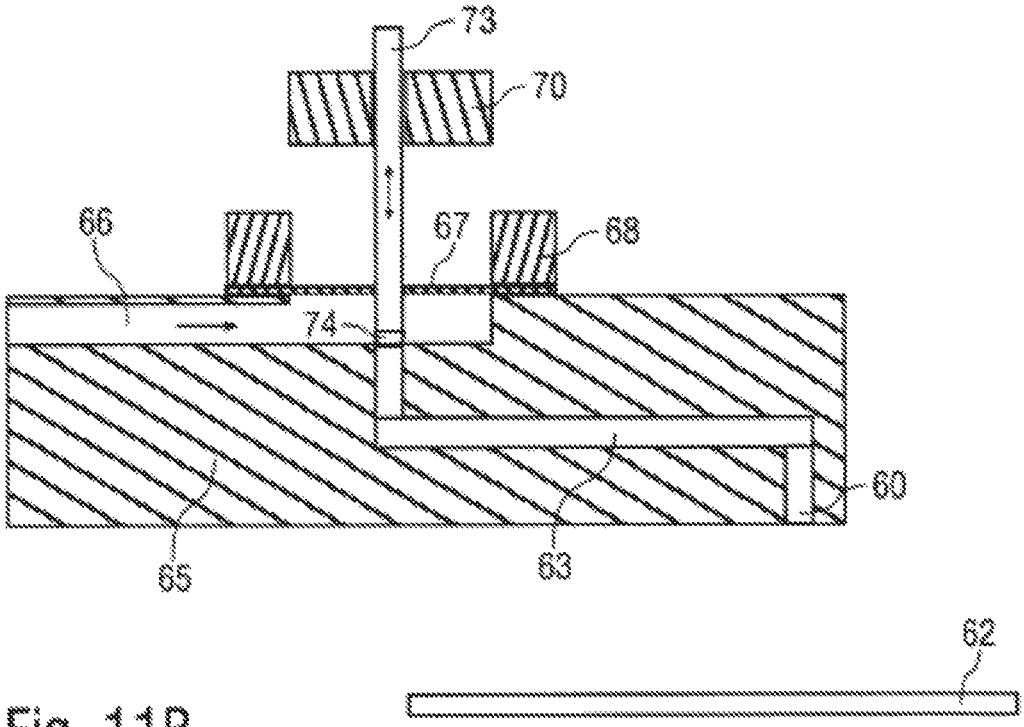
FIG. 11B shows the diagram according to FIG. 11A when the control valve is closed.

FIGS. 11A and 11B show a further variation of the embodiment given in FIGS. 9A and 9B, so that to avoid repetition, reference is made to the above description, using the same reference signs for the relevant details.

A feature of this example is that the valve seat 64 is not closed by the valve membrane 67. Rather, a valve needle 73 is passed through the valve membrane 67, which can be moved in the direction of the double arrow and carries a separate sealing element 74 at its tip. In the closed position according to FIG. 11B, the sealing element 74 then seals the valve seat 64. In the open position according to FIG. 11A, the valve needle 73 with the sealing element 74 is lifted off the valve seat 64 and thus releases it.

The valve membrane 67 only has the function of separating the coating-filled supply channel 66 from an actuator chamber so that the actuator chamber is not contaminated by the coating in the supply channel 66.

Figure 12:
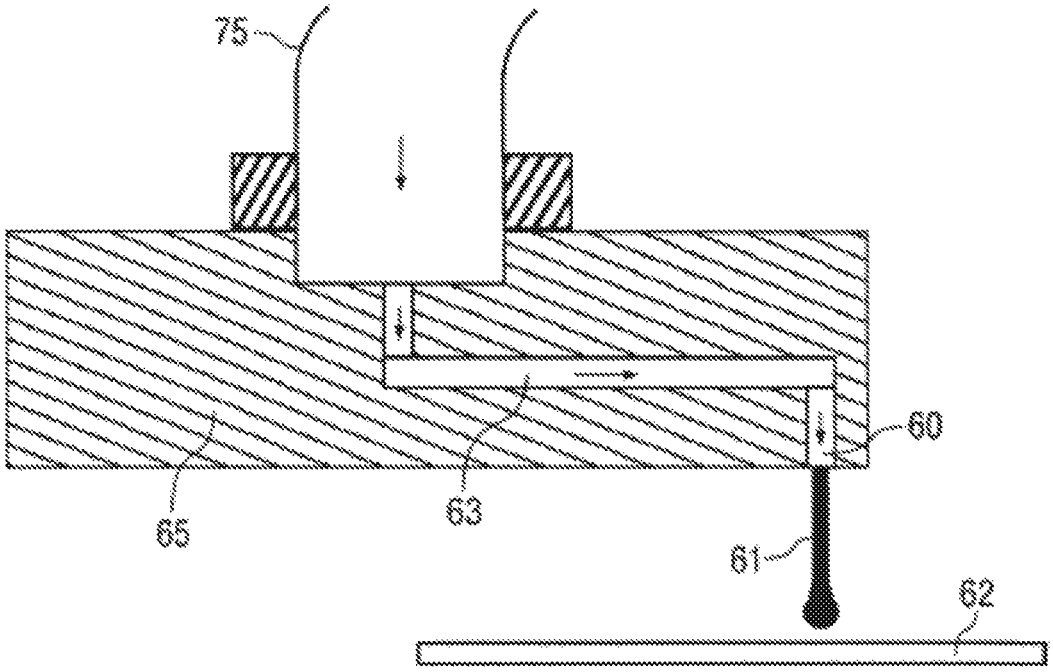
FIG. 12 is a variation of FIG. 9A with the control valves located outside the printhead.

FIG. 12 shows a further variation of the embodiment according to FIGS. 9A and 9B, so that to avoid repetitions, reference is made again to the above description, using the same reference signs for corresponding details.

A feature of this embodiment is that the control valves are separated from the printhead and are connected to the printhead via a hose 75.

Figure 13:
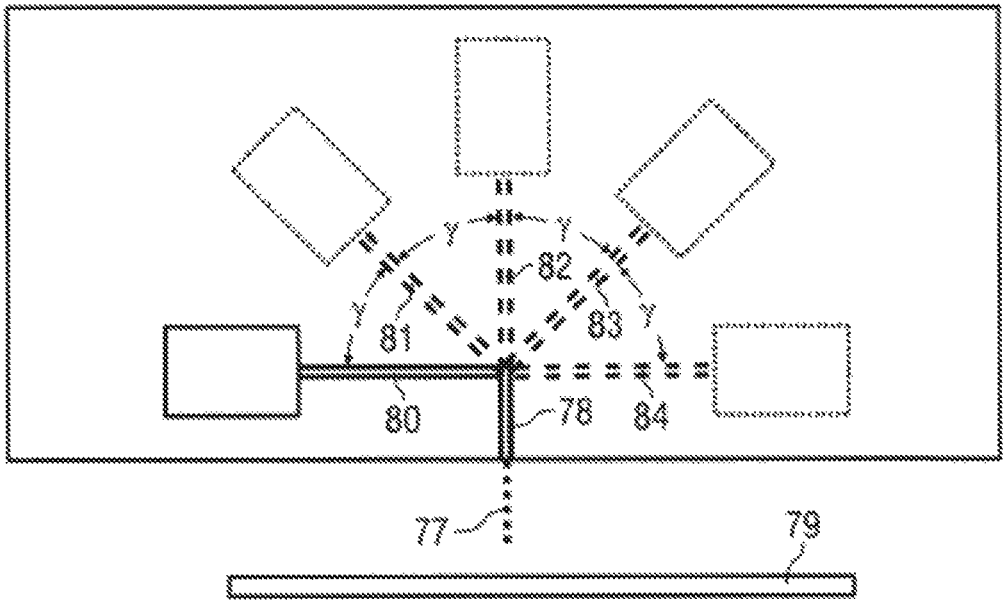
FIG. 13 shows a schematic representation of the spatial pulling-apart of the control valves in different directions.

FIG. 13 shows another possible embodiment of a printhead 76 for applying a spray of coating agent 77 from a nozzle 78 to a component 79.

Here the nozzles 78 are connected via flow channels 80-84 with valve seats in different angular orientations alternately along the nozzle row (i.e. perpendicular to the drawing plane). The drawing plane thus forms a pulling-apart plane, whereby the flow channels 80-84 point in different directions and thus allow spatial pulling-apart, which in turn allows a reduction of the nozzle distance d.

Figure 14:
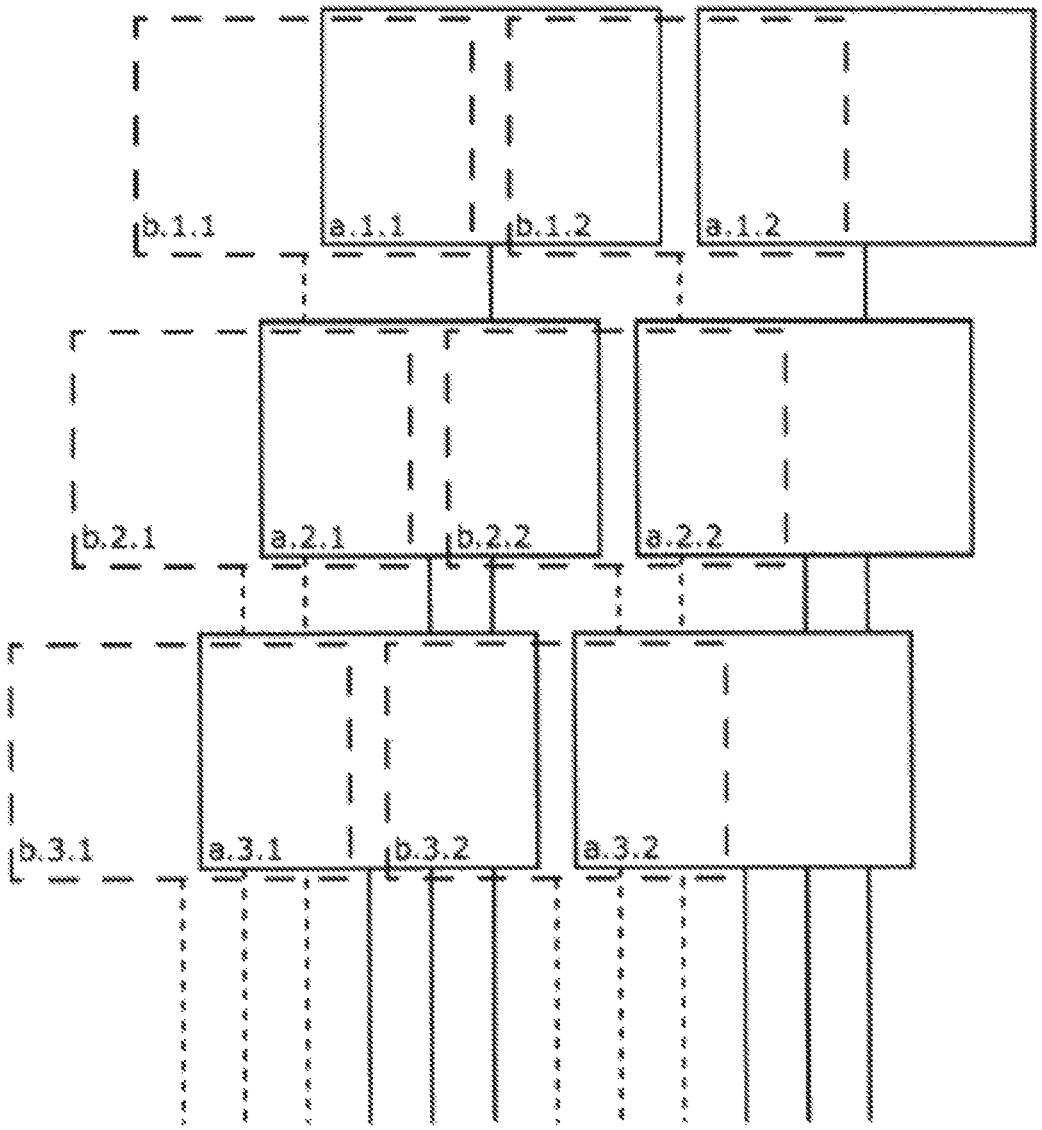
FIG. 14 shows a schematic representation of the spatial pulling-apart of the actuators in vertical and horizontal direction.

Finally, FIG. 14 shows a schematic illustration of the spatial pulling-apart of actuators, both in the vertical direction (i.e. perpendicular to the nozzle plane) and in the horizontal direction (i.e. parallel to the nozzle plane).

Here two actuator rows are arranged parallel to each other and parallel to the nozzle row in three actuator planes shown as examples.

In the upper actuator plane, the right actuator row comprises two actuators a.1.1 and a.1.2 as examples, while the other actuator row comprises two actuators b.1.1 and b.1.2 as examples.

The same applies to the middle actuator plane, which also has two actuator rows with two actuators each a.2.1, a.2.2 and b.2.1 and b.2.2 respectively.

Finally, the lower actuator plane also contains two actuator rows each with two actuators a.3.1, a.3.2 and b.3.1, b.3.2 as examples.

It should be mentioned here that the number of actuators in the individual actuator rows is considerably larger in practice than shown and described above for illustration purposes.

The disclosure is not limited to the preferred embodiments described above. Rather, a large number of variants and variations are possible which also make use of the disclosure idea and therefore fall within the scope of protection.

The invention claimed is:

1. An applicator for applying a coating agent to a component, comprising:

a) at least one nozzle row having a plurality of nozzles for dispensing the coating agent in the form of a coating agent jet, the plurality of nozzles arranged one behind the other along the nozzle row at a specific nozzle spacing in a nozzle plane, b) a plurality of actuators for controlling the release of the coating agent through individual nozzles of the plurality nozzles, the actuators each having an outer dimension along the nozzle row, and c) a plurality of control valves for controlling the release of the coating agent through the nozzles, the control valves being driven by the actuators, d) wherein the control valves are each spatially separated from the associated nozzle and are each connected to the associated nozzle via a flow channel in order to enable spatial pulling-apart of the nozzles on the one hand and of the control valves on the other hand, e) wherein the control valves are arranged with their shut-off point offset laterally with respect to the nozzle row in order to be able to reduce the nozzle spacing, and f) wherein the nozzle spacing between adjacent nozzles of the nozzle row is smaller than the outer dimension of individual actuators along the nozzle row.

2. An applicator according to claim 1, wherein a) the control valves are arranged on either side of the nozzle row in two valve rows which are opposite one another with respect to the nozzle row, and b) the nozzles are connected along the nozzle row alternately via the flow channels to control valves of the opposite valve rows.

3. An applicator according to claim 1, wherein the flow channels depart from the nozzle row in a pulling-apart plane at right angles to the nozzle row in more than two different directions.

4. An applicator according to claim 3, wherein the different directions of the flow channels in the pulling-apart plane each include an angle of 20°-70°.

5. An applicator according to claim 3, wherein the nozzles are connected to one of the different flow channels alternately along the nozzle row.

6. An applicator according to claim 5, wherein a) the actuators are arranged in a plurality of actuator planes, the individual actuator planes extending parallel to the nozzle plane and to the valve seat row, and b) two actuator rows are arranged in each of the individual actuator planes on either side of the nozzle row and the valve seat row, the actuator rows each containing a plurality of actuators.

7. An applicator according to claim 6, wherein a) the actuator planes arranged vertically one above the other have a horizontal offset with respect to one another which is substantially equal in magnitude to the nozzle spacing between the adjacent nozzles in the nozzle row or corresponds to an integer multiple of the nozzle spacing and b) the actuators in the actuator rows are arranged substantially equidistantly.

8. An applicator according to claim 1, wherein a) the actuators are arranged in a plurality of actuator planes, the actuator planes extending parallel to the nozzle plane and to the valve seat plane at different distances from the nozzle plane and to the valve seat plane, and b) the actuators in the individual actuator planes are each arranged in a plurality of actuator rows parallel to the nozzle row and to the valve seat row on both sides of the nozzle row and the valve seat row.

9. An applicator according to claim 1, wherein a) the distance between the control valves and the associated nozzles is partly different, so that the flow channels bridge partly different distances, and b) the flow channels have pressure compensation means for compensating the different distances, the pressure compensation means at least partially compensating the different pressure losses along the flow channels of different lengths, and c) the pressure compensation means consist essentially of one of the following:

c1) a meandering course, c2) a zigzag channel shape, c3) a spiral channel shape;

c4) a channel narrowing.

10. An applicator according to claim 1, wherein a) the individual control valves each have a valve seat, which can be selectively closed or released, and b) the individual valve seats each have a clear diameter of 50 μm-1500 μm.

11. An applicator according to claim 10, wherein a deflectable valve element is provided, this valve element selectively releasing or closing the valve seat as a function of its deflection.

12. An applicator according to claim 11, wherein, for the deflection of the valve element a displaceable plunger is provided which, in a closed position, presses the valve element against the valve seat and thereby seals the latter.

13. An applicator according to claim 11, wherein, for the deflection of the valve element a pressure chamber is provided, the pressure chamber applying an adjustable pressure to the valve element in order to selectively press the valve element against the valve seat and thereby seal it or release the valve seat.

14. An applicator according to claim 11, wherein a) the valve element extends over a plurality of the valve seats and can be individually deflected for the individual valve seats, and b) the valve element separates an actuator chamber from a coating agent-filled supply line chamber and thereby prevents the actuators in the actuator chamber from being contaminated by the coating agent, and c) the individual control valves each have a return spring, the return spring biasing the plunger into a closed position or into an open position.

15. An applicator according to claim 11, wherein a) a displaceable valve needle is provided, the valve needle selectively releasing or closing the valve seat as a function of its position, and b) the valve needle is passed through a sealing element, the sealing element separating an actuator chamber from a feed line chamber filled with coating agent and thereby preventing the actuators in the actuator chamber from being contaminated by the coating agent.

16. An applicator according to claim 15, wherein the valve needle has a separate sealing element at its tip.

17. An applicator according to claim 11, wherein the valve needle or the plunger are each displaced by one of the actuators.

18. An applicator according to claim 17, wherein the actuators are each single-acting and actively move the valve needle or the plunger only in one direction, whereas the valve needle or the plunger is moved in the opposite direction by a return spring.

19. An applicator according to claim 17, wherein the actuators are each double-acting and actively move the valve needle or the plunger in both directions.

20. An applicator according to claim 10, wherein a) adjacent valve seats of the control valves are arranged parallel to the nozzle row at a first spacing, b) the adjacent nozzles are arranged along the nozzle row at a second distance, and c) the first distance between the adjacent valve seats is at least twice as large as the second distance between the adjacent nozzles.

21. An applicator according to claim 1, wherein the control valves are arranged outside the applicator and are connected to the applicator by a fluid line.

22. An applicator according to claim 1, wherein a) the flow channels are fed with the coating agent from a supply channel, and b) the supply channel has a channel height of 100 μm-2000 μm, and c) the supply channel has a channel width of 1 mm-5 mm, and d) the supply channel has a channel length of 1 mm-100 mm.

23. An applicator according to claim 22, wherein the flow channel and the supply channel are made by one of the following manufacturing methods:

a) lithographic process, b) 3D printing, c) Victim layer method, d) Escargot procedure
e) LIGA procedure,
f) thermal bonding,
g) diffusion welding,
h) laser ablation,
i) laser cutting,
j) Bonding, hot stamping,
k) etching process,
l) injection moulding,
m) selective laser sintering,
n) selective laser melting
o) mechanical processing,
p) a combination of the above methods.

24. An applicator according to claim 22, wherein the flow channel and the supply channel extend in a substrate made of a material which is inert towards the coating agent.

25. An applicator according to claim 1, wherein a) the flow channels include an angle of 0°-90° with the coating agent jet at least over part of their length, and
b) the flow channels extend over at least part of their length at an angle of 0°-90° to the nozzle row, and
c) the flow channels extend over at least part of their length at an angle of 0°-90° to the coating agent jet and orthogonal to the nozzle row, and
d) the flow channels each have a channel cross-section with a channel height of 50 μm-1000 μm, and
e) the flow channels each have a channel cross-section with a channel width of 50 m-1000 m, and
f) the flow channels each have a channel length of 0.1 mm-50 mm, and
g) the flow channels between the shut-off point of the control valves and the nozzles each have a small volume of less than 1 mL, and
h) the nozzle spacing along the nozzle row is smaller than 3 mm, and
i) the control valves are arranged at a distance of at least 1 mm from the nozzle row, and
j) the nozzles are arranged equidistantly along the nozzle row.

26. Coating robot having an applicator according to claim 1.

27. An applicator for applying a coating agent to a component, comprising:

a) at least one nozzle row having a plurality of nozzles for dispensing the coating agent in the form of a coating agent jet, the plurality of nozzles arranged one behind the other along the nozzle row at a specific nozzle spacing in a nozzle plane, and
b) a plurality of actuators for controlling the release of the coating agent through individual nozzles of the plurality of nozzles, the actuators each having an outer dimension along the nozzle row,
c) wherein the nozzle spacing between adjacent nozzles of the nozzle row is smaller than the outer dimension of individual actuators along the nozzle row,
d) wherein the actuators are arranged in a plurality of actuator planes, the actuator planes extending parallel to the nozzle plane and to the valve seat plane at different distances from the nozzle plane and to the valve seat plane, and
e) wherein the actuators in the individual actuator planes are each arranged in a plurality of actuator rows parallel to the nozzle row and to the valve seat row on both sides of the nozzle row and the valve seat row.

28. An applicator for applying a coating agent to a component, comprising:

a) at least one nozzle row having a plurality of nozzles for dispensing the coating agent in the form of a coating agent jet, the plurality of nozzles arranged one behind the other along the nozzle row at a specific nozzle spacing in a nozzle plane, and
b) a plurality of actuators for controlling the release of the coating agent through individual nozzles of the plurality of nozzles, the actuators each having an outer dimension along the nozzle row,
c) wherein the nozzle spacing between adjacent nozzles of the nozzle row is smaller than the outer dimension of individual actuators along the nozzle row,
d) wherein flow channels connected to the plurality of nozzles are fed with the coating agent from a supply channel,
e) wherein the supply channel has a channel height of 100 μm-2000 μm,
f) wherein the supply channel has a channel width of 1 mm-5 mm, and
g) wherein the supply channel has a channel length of 1 mm-100 mm.

* * * * *